US005845338A

United States Patent [19]

Clark

[11] Patent Number: 5,845,338

[45] Date of Patent: Dec. 8, 1998

[54] MULTI USE HEAD COVER

[76] Inventor: Jeffrey Clark, 6 Ridgemark Ct., Sacramento, Calif. 95831

[21] Appl. No.: 843,564

[22] Filed: Apr. 18, 1997

[51] Int. Cl.[6] ..... A42B 1/20

[52] U.S. Cl. ..... 2/195.1; 2/195.2; 2/171.1; 2/209.11

[58] Field of Search ..... 2/195.1, 195.2, 2/171.1, 209.11

[56] References Cited

U.S. PATENT DOCUMENTS

| | | | |
|---|---|---|---|
| 4,023,212 | 5/1977 | Huffman | 2/171.1 X |
| 4,873,726 | 10/1989 | Tapia | 2/195.1 |
| 5,070,545 | 12/1991 | Tapia | 2/171.1 X |
| 5,099,524 | 3/1992 | Linday | 2/171.1 X |
| 5,437,062 | 8/1995 | Douglas | 2/195.1 |
| 5,471,684 | 12/1995 | Casale | 2/195.1 |
| 5,613,246 | 3/1997 | Alexander | 2/195.1 X |

*Primary Examiner*—C. D. Crowder
*Assistant Examiner*—Shirra L. Jenkins
*Attorney, Agent, or Firm*—Beehler & Pavitt

[57] ABSTRACT

A multi use head cover comprising an adjustable size visor portion and a detachable fabric head covering portion. The visor portion includes a visor band with a divided after section joined by a pair of interlocking plastic strips. A bill is attached to a forward portion of the visor band which is raised relative to the after end and sides to provide effective sun shading. An upper edge of the visor band is trimmed with a first half of a zipper. The second half of the zipper is attached to the corresponding edge of a fabric dome in the shape of a conventional yarmulke. The after edge of the dome may be recessed to correspond with the gap in the upper edge of the after section of the visor band to prevent bunching of the fabric dome when the visor band is adjusted to smaller sizes. The user of the invention may either start with the fully assembled baseball type cap and, when desired, the domed section may be removed to leave a conventional visor, or the visor portion may be put away and the fabric dome placed on the wearer's head as a yarmulke when desired.

3 Claims, 2 Drawing Sheets

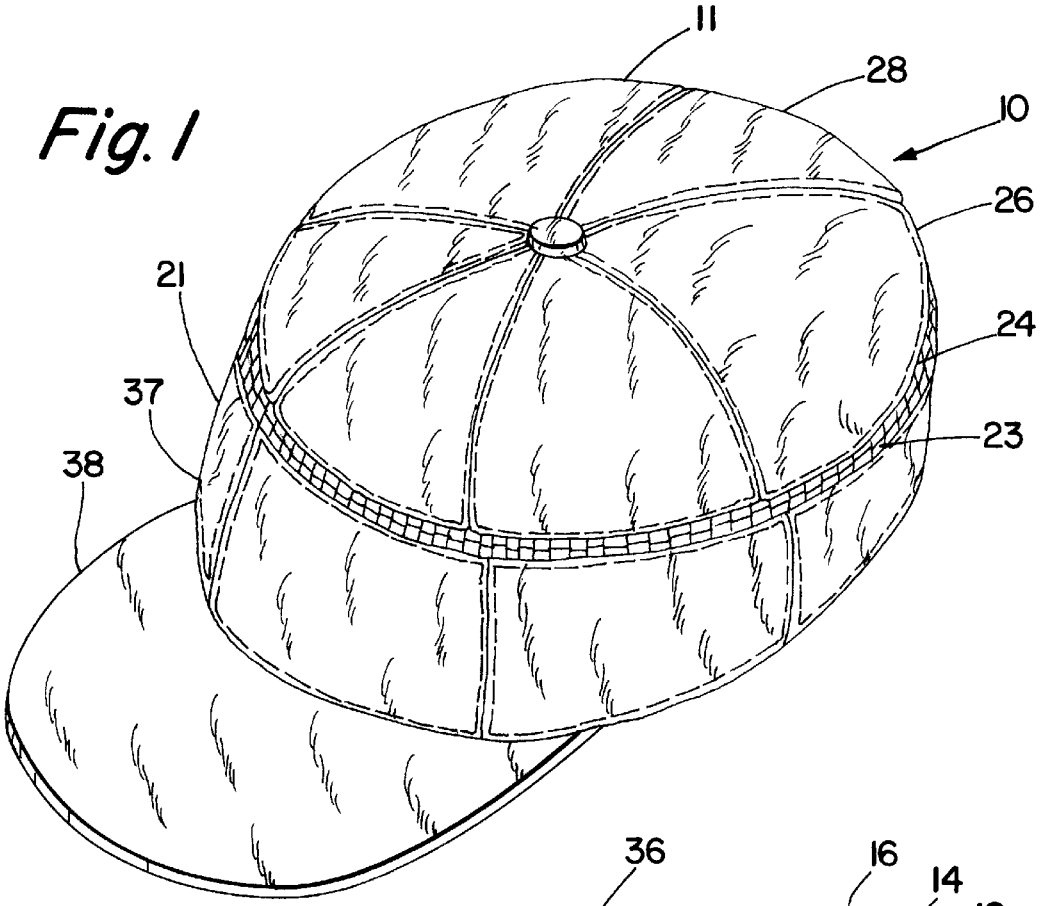
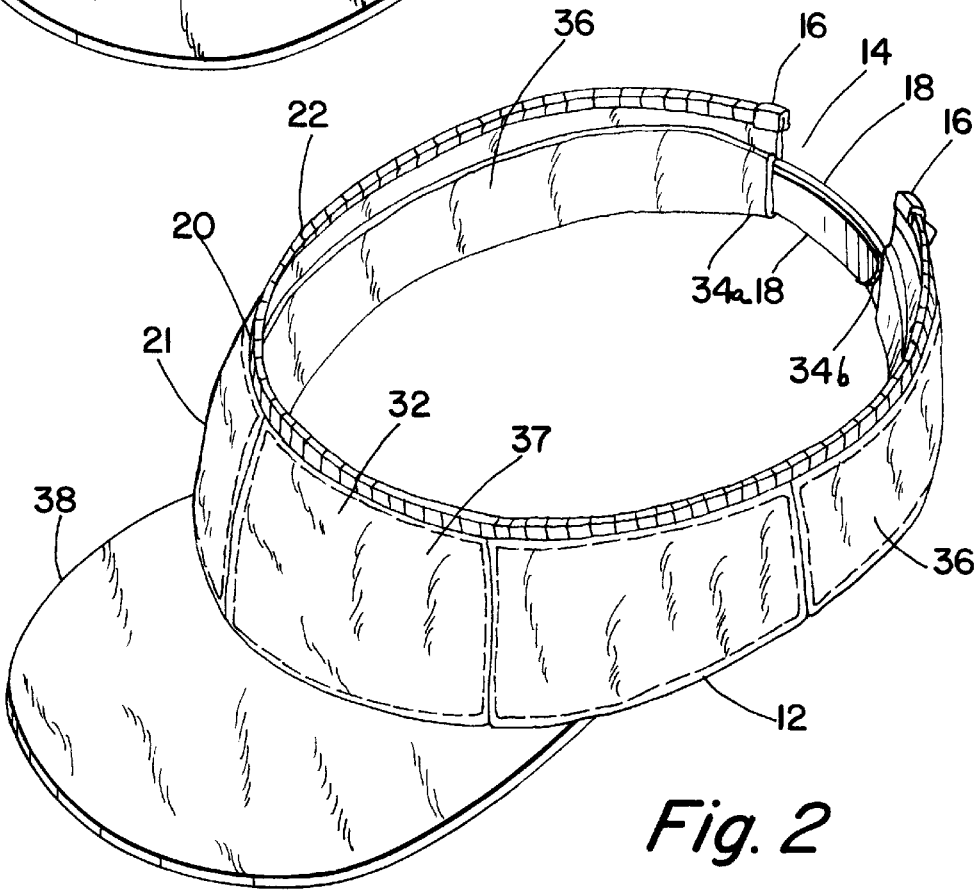
Fig. 2

MULTI USE HEAD COVER

BACKGROUND OF THE INVENTION

1. Field of the Invention

This invention relates generally to the field of head coverings and, in particular, to head coverings of the type often referred to as visor caps.

2. Description of the Prior Art

Cap type head coverings have been devised in numerous forms for more than a century.

Hats and caps have generally been made to fit a specific size head. Consequently, one would acquire a hat or cap of a specific size to fit his head. Thus, a hat made, for example, of 6⅞th inches size would not fit on a head of a seven and a ¼ size. Conversely, a 7¼ size cap would come down uncomfortably on the head of one of a 6⅞ size. However, within the past two or three decades, visors have been made with adjustable complimentary rear plastic straps, one having a plurality of orifices and the other, a plurality of projections designed to fit into the orifices. This has enabled the visors to be adjusted to fit a fairly wide range of head sizes. Such adjustability, however, has generally not been found to be suitable for a full head covering cap associated with a visor since moving the straps relative to each other may either not be possible where it is sought to expand the size of the head to be accommodated; and, where the straps are moved together for a smaller head size, the result may be a bunching-up of a portion of the rear of the top of the head covering. Size adjustability, therefore, has been generally limited to visors.

It has also been a feature of the prior art to provide for means for detaching the actual hair covering from the band or visor portion of the hat cap. Examples of this may be seen in U.S. Pat. Nos. 5,437,062; 5,471,684; 5,070,545; 2,686,919; 2,844,824 and Des. 237,758. However, in the prior art either the removal or reattachment process is complicated and expensive to fabricate, or the components when broken down may serve no separate purpose or do so inadequately. Thus, when the actual hair cover portion has been removed, it is simply set aside until it is desired to re-assemble it with the visor or band and bill portion.

SUMMARY OF THE INVENTION

The present invention involves a head covering which may have three entirely different uses, namely, as a baseball-type cap, as a visor, and as a yarmulke (A skullcap worn by Jewish men and boys, especially those adhering to Orthodox or Conservative Judaism[1]). A yarmulke is a ceremonial head covering sized and proportioned to cover only the crown of the head and does not extend downwardly to cover the sides of the head.

[1]Excerpted from *The American Heritage® Dictionary of the English Language, Third Edition*© 1996 by Houghton Mifflin Company. Electronic version licensed from INSO Corporation; further reproduction and distribution in accordance with the Copyright Law of the United States. All rights reserved.

This capability of the head covering of the present invention is achieved by providing an adjustable visor having a visor band with an enlarged forward area and a gap between a divided after section which is spanned by complimentary interlocking plastic strips. The upper edge of gapped visor band is trimmed with one side strip of a zipper, the other side strip of which is disposed along a corresponding edge of a fabric dome in the shape of a conventional yarmulke. That is, a ceremonial head covering sized and proportioned to cover only the crown of the head that does not extend downwardly to cover the sides of the head. The after edge of the dome may be recessed to correspond with the gap in the upper edge of the after section of the visor band. Thereby, when the head size of the visor is decreased by bringing the opposed after ends of the band closer together, the dome will simply have a minimal bunching-up in the recess. In order to provide an effective visor and to yield a yarmulke of appropriate size and proportions, the forward area of the band is raised relative to the after ends and the sides are tapered from the higher front end toward the after ends of the band. Likewise, the side strips for the zipper are raised above the interlocking plastic strips, to reduce the size of the yarmulke portion to an appropriate size. A bill is provided to extend outwardly from the forward part of the band which is configured to cover all or a portion of the wearer's forehead. When the head covering of the present invention is employed, the user may either start with the fully assembled baseball type cap and, when desired, the domed section may be removed to leave a conventional visor, or the visor portion may be put away and the fabric dome placed on the wearer's head as a yarmulke where desired for religious occasions or events. Alternatively, the domed portion may be initially utilized as a yarmulke when a young person, for example, attends Hebrew school or some other temple event. However, when the school or event is terminated and the young person (or adult) may wish to witness or engage in some sport, he may either remove the yarmulke and utilize the visor portion of the head covering, or he may zip the lower edge of the domed portion onto the upper edge of the visor band to provide a full baseball cap.

The present invention, then, will have particular interest and use in the practice of the Jewish faith, although, the head covering may either be utilized as a baseball cap or visor by persons of any other faith.

Description of the Drawings

FIG. 1 is a perspective view of a fully assembled head cover of the present invention.

FIG. 2 is a similar perspective view of the visor portion of the head covering from which the dome has been removed.

DESCRIPTION OF THE PREFERRED EMBODIMENT

FIG. 1 of the application illustrates an embodiment of the invention with all of its constituent parts attached forming a head covering of conventional form and appearance traditionally referred to as a baseball cap.

Figure 3:
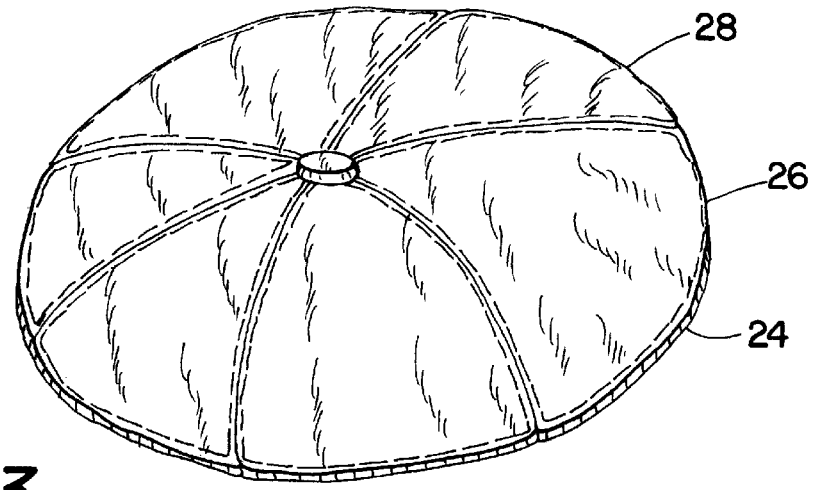
FIG. 3 is a perspective view of the fabric dome.

Referring to FIGS. 1–3, a multi use head covering 10, is constructed by providing an adjustable visor 12 having a visor band 21 with enlarged forward area 32 having a second a second predetermined height and a gap 14 between a divided after section 16 which is spanned by complimentary interlocking plastic strips 18.

Figure 5:
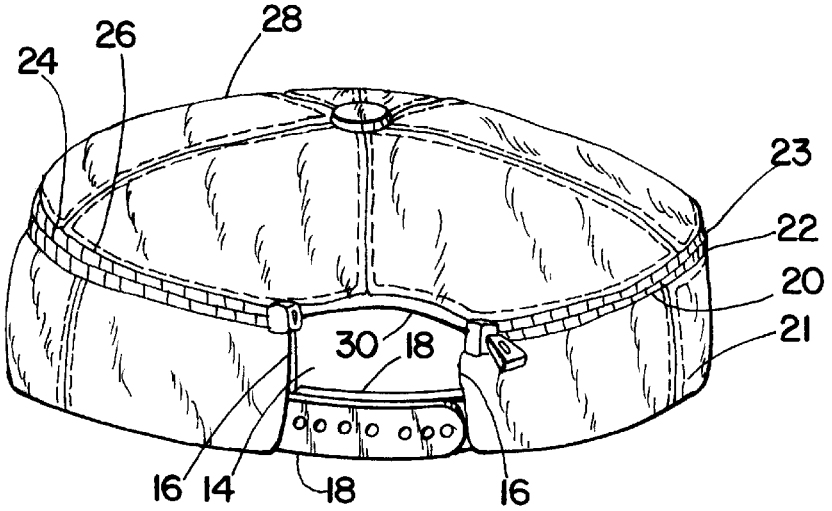
FIG. 5 is a rear view of the head covering shown in FIG. 1.

The upper edge 20 of arcuate fabric band portion 21 is trimmed with one side strip 22 of a zipper 23, the other side strip 24 of which is disposed along a corresponding edge 26 of a fabric dome 28 in the shape of a conventional yarmulke (FIG. 3). The after edge 30 of the dome may have a lower edge of a configuration conforming to the configuration of the gap 14 in the upper edge and the lower edge of the after section 16 of the band portion 21. Thereby, when the head size of the visor 12 is decreased by bringing first end 34*a* of the band 21 closer to second end 34*b* thereby defining a predetermined area by the movement of the first end 34*a* and the second end 34*b* relative to each other; closer together, the dome 28 will simply have a minimal bunching-up in the recess 14 (FIG. 5). First end 34*a* and second end 34*b* both have a first predetermined height. Means to change the disposition of first end 34*a* with respect to second end 34*b* is provided by a pair of plastic strips 18, one secured to the first end 34*a* and the other secured to the second end 34*b* of the band portion 21, one of the plastic strips 18 having a plurality of orifices and the other plastic strip 18 having at least one projection adapted to fit in each of the last said orifices.

Figure 4:
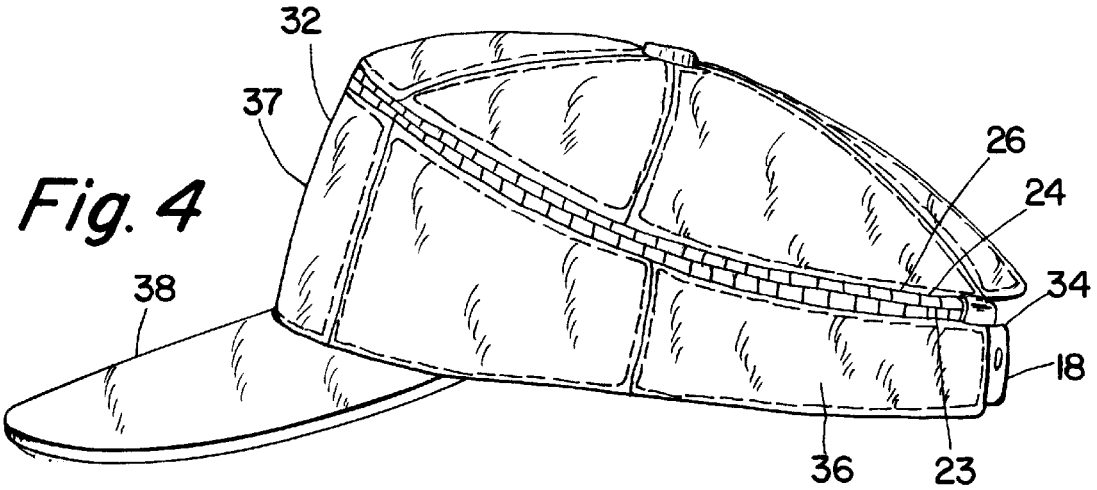
FIG. 4 is a side elevation of the head covering shown in FIG. 4.

Referring to FIGS. 1,2 and 4, to provide an effective visor 12 and to yield a yarmulke of appropriate size and proportions that covers only the crown of the head and does not extend downwardly to cover the sides of the head, the forward area 32 of the band 21 is raised relative to the after ends 34 and the sides 36 are tapered from the higher front end 37 toward the after ends of the band 21. Likewise, the side strips 22, 24 for the zipper 23 are raised above the interlocking plastic strips 18, to reduce the size of the yarmulke portion to an appropriate size. A bill 38 is provided to extend outwardly from the forward part 32 of the band 21 which is configured to cover all or a portion of the wearer's forehead.

When the head covering of the present invention 10 is employed, the user may either start with the fully assembled baseball type cap 11 and, when desired, the domed section 28 may be removed to leave a conventional visor 12, or the visor portion 12 may be put away and the fabric dome 28 placed on the wearer's head as a yarmulke where desired for religious occasions or events.

I claim:

1. A head covering comprising:

an arcuate fabric band portion having a first end of a first predetermined height and disposed adjacent the back side of the wearer's head and extending around the wearer's forehead to provide an enlarged forward area of a second predetermined height, and continuing around the wearer's head to terminate in a second end of the first predetermined height and also disposed adjacent the backside of the wearer's head, said second predetermined height being greater than said first predetermined height;

said band portion having an upper edge and lower edge, said upper edge including a first portion of an attachment means and defining a predetermined area;

means to adjust the quantum of said predetermined area comprehended by said band portion by enabling the disposition of said first and second ends of the band portion to be changed relative to each other;

a bill secured to and extending outwardly and forwardly from the lower edge of the arcuate band portion of said enlarged forward area;

a dome-shaped fabric cover, said cover being spaced above the first and second ends of the band and sized and proportioned to cover only the crown of a wearer's head and having a lower edge including a second, mating portion of an attachment means and being of a configuration conforming to the configuration of the upper edge of the band portion;

said attachment means removably engaging the upper edge of the band and the lower edge of the fabric dome; and whereby the dome may, at the option of the wearer, be removed from the upper edge of the band portion to leave a size adjustable visor, and the removed dome-shaped fabric may be placed upon the head as a yarmulke wholly separate from the band portion.

2. The head covering as defined in claim 1 wherein the means to removably engage the upper edge of the band portion with the lower edge of the fabric dome is an interlocking zipper.

3. The head covering as defined in claim 1 wherein the means to change the disposition of the first and second band ends comprise a pair of plastic strips, one secured to the first end of the band and the other secured to the second end of the band, one of said strips having a plurality of in-line orifices and the other strip having at least one projection adapted to fit in each of the last said orifices.

* * * * *